US005900570A

United States Patent [19]

Rossum

[11] Patent Number: 5,900,570

[45] Date of Patent: May 4, 1999

[54] METHOD AND APPARATUS FOR SYNTHESIZING MUSICAL SOUNDS BY FREQUENCY MODULATION USING A FILTER

[75] Inventor: David P. Rossum, Aptos, Calif.

[73] Assignee: Creative Technology, Ltd., Crescent, Singapore

[21] Appl. No.: 08/418,957

[22] Filed: Apr. 7, 1995

[51] Int. Cl.[6] ..... G10H 1/057; G10H 1/08; G10H 1/12

[52] U.S. Cl. ..... 84/653; 84/660; 84/661; 84/663; 84/DIG. 9

[58] Field of Search ..... 84/622–625, 659–661, 84/692–700, DIG. 9, DIG. 10, 653–658, 662–665

[56] References Cited

U.S. PATENT DOCUMENTS

| | | | |
|---|---|---|---|
| Re. 34,481 | 12/1993 | Ishibashi . | |
| 3,515,039 | 6/1970 | Omura et al. . | |
| 3,534,144 | 10/1970 | Ring . | |
| 3,649,821 | 3/1972 | Gumacos . | |
| 3,888,153 | 6/1975 | Deutsch . | |
| 3,979,991 | 9/1976 | Kawamoto . | |
| 4,018,121 | 4/1977 | Chowning . | |
| 4,130,876 | 12/1978 | Mitsuhashi . | |
| 4,135,422 | 1/1979 | Chibana . | |
| 4,175,464 | 11/1979 | Deutsch . | |
| 4,208,940 | 6/1980 | Tsurubuchi | 84/694 X |
| 4,259,888 | 4/1981 | Gross . | |
| 4,297,933 | 11/1981 | Nishimoto . | |
| 4,318,045 | 3/1982 | Krupa et al. . | |
| 4,343,128 | 8/1982 | Mena . | |
| 4,453,869 | 6/1984 | Cremieux . | |
| 4,554,858 | 11/1985 | Wachi et al. . | |
| 4,942,799 | 7/1990 | Suzuki | 84/624 X |
| 5,113,740 | 5/1992 | Saito . | |
| 5,117,725 | 6/1992 | Takauji et al. . | |
| 5,136,917 | 8/1992 | Kunimoto | 84/624 |

(List continued on next page.)

FOREIGN PATENT DOCUMENTS

| | | |
|---|---|---|
| 0454047 | 10/1991 | European Pat. Off. . |
| 0484048 | 5/1992 | European Pat. Off. . |
| 2103005 | 2/1983 | United Kingdom . |
| WO 95/06859 | 3/1995 | WIPO . |

OTHER PUBLICATIONS

DSP 16 Plus and DSP 16 User's Manual, Cardinal Technologies, Inc., 1827 Freedom Road, Lancaster, PA 17601 (1993).

"Introducing the EuPhonics Newsletter,"*EuPhonics Newsletter*, vol., No. 1, ¶3 (1993).

"Music Synthesis & Dolby AC–2 from EuPhonics,"*Analog Devices DSPatch*, No. 25, pp. 9–10 (1992).

"ICASSP Exhibit Guide: Music Synthesis with Multi–dimensional Sound,"*Analog Devices DSPatch*, No. 27, p. 7 (1993).

(List continued on next page.)

*Primary Examiner*—Stanley J. Witkowski
*Attorney, Agent, or Firm*—Morrison & Foerster

[57] ABSTRACT

This invention provides a circuit for synthesizing musical sounds. In one embodiment, the circuit includes a first order FIR highpass filter that is placed between a modulation phase increment oscillator and a carrier phase increment oscillator. The invention may also include waveshaping circuits, adders, multipliers, time division multiplexing, and other types of filters. Another embodiment of the invention provides a music synthesis method where a modulation phase increment is multiplied by a modulation index to produce a modulation signal. That modulation signal is then filtered and added to a carrier phase increment. Finally, that sum is multiplied by an amplitude envelope to produce a signal representing a musical sound. The method may include using a first order FIR highpass filter, waveshaping of both sinusoidal and non-sinusoidal waveforms, additional multiplying and time division multiplexing. The invention also includes self-modulation and cascading.

47 Claims, 10 Drawing Sheets

U.S. PATENT DOCUMENTS

| | | | |
|---|---|---|---|
| 5,157,215 | 10/1992 | Nakae et al. . | |
| 5,187,677 | 2/1993 | Kovalick . | |
| 5,223,653 | 6/1993 | Kunimoto et al. | 84/624 |
| 5,223,656 | 6/1993 | Higashi | 84/661 |
| 5,243,658 | 9/1993 | Sakata | 84/624 X |
| 5,298,676 | 3/1994 | Sasaki et al. | 84/624 |
| 5,308,918 | 5/1994 | Yamauchi et al. | 84/624 X |

OTHER PUBLICATIONS

Alles, H.G., et al., "A–One Card 64 Channel Digital Synthesizer," *Computer Music Journal*(1977) 1(3):7–9.

Bate, John A., "The Effect of Modulator Phase on Timbres in FM Synthesis," *Computer Music Journal*(1990) 14(3):38–45.

Chowning, John M., "The Synthesis of Complex Audio Spectra by Means of Frequency Modulation," *Journal of the Audio Engineering Society*(1973) 21(7):526–35 (reprinted in *Computer Music Journal*(1977) 1(2):46–54).

Holm, Frode, "Understanding FM Implementations: A Call for Common Standards," *Computer Music Journal*(1973) 16(1):34–42.

Hutchins, Bernie, "Some Additional VCO Design Problems and Solutions: (E) Adding Linear FM," *Electronotes Newsletter*(1975) 7(49):6–7.

Hutchins, Bernie, "The ENS–76 Home–Built Synthesizer System –Part 7, VCO Options, Option 3," *Electronotes Newsletter*(1977) 9(75):14–16.

Matthews, Max V., The Technology of Computer Music, (M.I.T. Press 1969) pp. 48–53, 76–78 and 134–138.

Morrill, Dexter, "Trumpet Algorithms for Computer Composition," *Computer Music Journal* (Feb. 1977) pp. 46–52.

Samson, Peter R., "A General–Purpose Digital Synthesizer," *Journal of the Audio Engineering Society*(1980) 28(3):106–13.

Saunders, Steve, "Improved FM Audio Synthesis Methods for Real–Time Digital Music Generation," *Computer Music Journal*(Feb. 1977) pp. 53–55.

Smith, Julius O. III, Introduction To Digital Filter Theory, Report No. STAN–M–20 (Standford University, Center for Computer Research in Music and Acoustics 1985) (1981); reprinted in Digital Audio Signal Processing: An Anthology, (ed. John Strawn).

Snell, John, "Design of a Digital Oscillator Which Will Generate Up to 256 Low Distortion Sine Waves in Real Time," *Computer Music Journal*(1977) 1(1):4–25.

Wells, Thomas & Eric Vogel, The Techinque of Electronic Music, (University Stores, Inc. 1974).

#0
#1
#2
#3
#4
#5
#6
#7

METHOD AND APPARATUS FOR SYNTHESIZING MUSICAL SOUNDS BY FREQUENCY MODULATION USING A FILTER

FIELD OF THE INVENTION

This invention relates to a method and apparatus for synthesizing musical sounds by frequency modulation using a filter, and in particular, a highpass filter.

BACKGROUND OF THE INVENTION

Frequency modulation has become a popular technique for synthesizing musical sounds in applications where higher fidelity can be traded off for lower cost. Using frequency modulation to synthesize musical sounds ("FM synthesis") was first described by John Chowning in his landmark 1973 article "The Synthesis of Complex Audio Spectra by Means of Frequency Modulation," *Journal of the Audio Engineering Society,* vol. 21, no. 7, pp. 526–535. Chowning also described a particular frequency modulation technique in his article, which he pictured schematically as a MUSIC V "patch," or software code that can be patched into the MUSIC V sound synthesis program.

In his article, Chowning gave a mathematical formula for his frequency modulation technique, and he later obtained a patent, U.S. Pat. No. 4,018,121, based on that mathematical formula. Interestingly, although Chowning did not mention it, the formula he gave for his frequency modulation technique does not correspond to his MUSIC V patch. This has caused some confusion, since implementations based on the formula will sometimes give incompatible results to implementations based on the MUSIC V patch, even though it was thought that the implementations were the same. This confusion has taken some years to sort out.

Frode Holm gives perhaps the best summary of the resulting confusion and its resolution in his article "Understanding FM Implementations: A Call for Common Standards," *Computer Music Journal,* vol. 16, no. 1, pp. 34–42 (1992). Holm concludes that there are actually two distinct methods of FM synthesis, one using Chowning's formula and one using his particular MUSIC V patch implementation. Holm's analysis shows, mathematically, that Chowning's formula actually implements phase modulation, while the MUSIC V patch is "true" frequency modulation.

The respective mathematical formulas best illustrate the difference between Chowning's FM synthesis formula and his actual MUSIC V patch. Chowning's FM synthesis formula is:

$$E(t)=A(t)\sin(\omega_c ty+I(t)\sin(\omega_m t)) \quad (1)$$

where E(t) is the instantaneous amplitude of the synthesized musical note, $\omega_c$ is the carrier frequency, I(t) is the time varying modulation index, and $\omega_m$ is the modulation frequency. As is evident to those skilled in the art, I(t), $\omega_c$ and $\omega_m$ can be varied with time to create the desired "tone color" for the basic tone pitch provided by $\omega_c$.

In contrast, the MUSIC V patch presented by Chowning, expressed as a formula, is:

$$E(t)=A(t)\sin([\omega_c+I(t)\omega_m \sin(\omega_m t)]t) \quad (2)$$

Note that the differences between the two equations are that the modulation term is now multiplied by the factor $\omega_m$ and that the entire argument of the outer sine function, rather than just $\omega_c$, is now multiplied by the factor t. Because of these differences, the two approaches give incompatible results in some cases.

It should be noted that although these equations are helpful in understanding the theoretical basis for the two approaches, they only approximate the operation of the actual implementations of the Chowning formula and the MUSIC V patch. The operation of the actual implementations approaches the formulas above only as the sampling period used in the oscillators approaches zero. Moreover, the above formulas apply only when the waveform of the outputs of both the carrier and modulating oscillators are simple sine waves. When they are not, as is often the case, the actual operation of the implementation deviates from the applicable formula.

Following Chowning's article, a number of people designed real-time synthesizers using the techniques described by Chowning. Many designed implementations based on the MUSIC V patch. Most of these implementations used phase increment oscillators, which used as their frequency or "phase increment" input the sum of a static (or slowly time varying) frequency parameter and one or more audio rate "frequency modulation" inputs. Others designed analog implementations using analog voltage-controlled oscillators to implement the MUSIC V patch. Both the analog and digital implementations expanded on the Chowning article, demonstrating such features as multiple modulators and carriers, cascaded FM oscillators, and self-modulation.

Implementations based on the MUSIC V patch work quite well for music synthesis under very limited circumstances. If $\omega_m$ is essentially fixed (time varying only at very slow rates), I(t) can simply be appropriately scaled by the controlling computer without substantial extra computation. Furthermore, as shown above, the common factor "t" in the argument of the carrier sine function allows the "t" to be factored out of both terms. This then allows the output of the modulation oscillator, $I(t)\omega_m\sin(\omega_m t)$, to be added directly to the carrier frequency $\omega_c$ before applying this sum to the carrier oscillator phase increment input. Hence, this is truly frequency modulation, and the carrier oscillator need only have a single frequency input.

Unfortunately, if $\omega_m$ is time varying at a substantial rate, as is common in certain applications, then I(t) must be scaled in a rapidly time varying manner in order to produce reasonably sounding results. Because the number of multiplications per second required to accomplish this is substantial, implementations based on the MUSIC V patch become costly to implement.

Also, the MUSIC V patch itself gives similar audible results to the Chowning formula only when the modulator output waveform is nominally a sinusoid. If waveforms with substantial harmonic content are included, such as the commonplace sawtooth or square waveforms, some deviation occurs between the two formulas for each sinusoidal harmonic component of the waveform. Specifically, in such cases, the ith sinusoidal harmonic component in the MUSIC V patch must be multiplied by its own effective $\omega_{mi}$ to generate audibly similar results to the Chowning formula. Once the sinusoids are combined, as with a square or sawtooth waveform, this is impractical to do.

To avoid additional computations, most implementations based on the MUSIC V patch simply multiply by the $\omega_m$ for a nominal sinusoid, rather than multiplying each sinusoidal harmonic component by its own $\omega_m$. These implementations, therefore, give results that are not compatible with implementations based directly on the Chowning formula in cases where the modulator output is not nominally a sinusoid.

Accordingly, existing FM synthesis implementations based on the MUSIC V patch have some disadvantages. They require numerous multiplications, which are costly. They can also give incompatible results, particularly in the case of sawtooth and square waveforms. However, because they do not require two frequency inputs to the carrier phase increment oscillator, they do have some advantages over direct implementations of the Chowning formula.

In contrast to the MUSIC V patch, when implemented directly the Chowning formula performs "phase modulation" instead of true frequency modulation. Because a frequency integrated over time is a phase, the term $I(t)\sin(\omega_m t)$ in Chowning's formula is actually being added to a phase, $\omega_c t$, rather than a frequency. Moreover, this addition is done within the carrier phase increment oscillator, rather than as a distinct addition operation performed prior to the frequency being input to that oscillator, as is the case in true frequency modulation. Accordingly, as Holm points out, a direct implementation requires two distinct inputs into the carrier phase increment oscillator, one input representing the "static" frequency and the other a "phase modulation" increment value.

Like those based on the MUSIC V patch, existing phase modulation implementations based directly on the Chowning formula also have some disadvantages. They require a phase increment oscillator with both a frequency and a phase input, which adds complexity, and thus expense, to the circuitry required to implement the oscillator.

None of the existing implementations of either Chowning approach combines the advantages of the two approaches in a way that achieves reasonably sounding results that are audibly compatible. In particular, none combines the simplicity of the MUSIC V phase increment oscillator, with its single frequency input, with the minimal number of multiplications that can be achieved by the mathematically simpler phase modulation based directly on Chowning's formula. Moreover, unless a number of multiplications are done, none of the implementations based on the MUSIC V patch give audibly similar results for all types of waveforms, both sinusoidal and not, to the results of implementations based directly on Chowning's formula.

SUMMARY OF THE INVENTION

This invention provides a new circuit and method for synthesizing musical sounds. In one embodiment, the invention includes a first order FIR highpass filter that is placed between a modulation phase increment oscillator and a carrier phase increment oscillator. The invention may also include waveshaping circuits, multipliers, time division multiplexing, and other types of filters.

Another embodiment of the invention provides a music synthesis method where a modulation phase increment is multiplied by a modulation index to produce a modulation signal. That modulation signal is then filtered and added to a carrier phase increment. Finally, that sum is multiplied by an amplitude envelope to produce a signal representing a musical sound. The method may include using a first order FIR highpass filter, waveshaping of both sinusoidal and non-sinusoidal waveforms, additional multiplying and time division multiplexing.

The invention also includes self-modulation and cascading.

BRIEF DESCRIPTION OF THE DRAWINGS

The objects, features and advantages of the present invention will be apparent to one skilled in the art in light of the following detailed description in which.

DETAILED DESCRIPTION OF THE INVENTION

Before the present methods and apparatuses are described, it is to be understood that this invention is not limited to the particular apparatuses or methods described as such, which those of skill in the art can, of course, vary. It is also to be understood that the terminology used herein is for the purpose of describing particular embodiments only, and is not intended to be limiting as to the scope of the present invention, which will be limited only by the appended claims.

It should be noted that, as used in this specification and the appended claims, the singular forms "a", "an" and "the" include the plural referents unless the context clearly dictates otherwise.

Unless defined otherwise, all technical and scientific terms used herein have the same meaning as commonly understood by one of ordinary skill in the art to which this invention belongs. Although any methods and materials similar or equivalent to those described herein can be useful in the practice or testing of the present invention, preferred methods and materials are described below. All publications and patents mentioned herein are incorporated herein by reference.

This invention provides a method and apparatus for replacing the multiplication by $\omega_m$ of the modulator output in a true frequency modulation implementation with a highpass filter. Rather than explicitly multiply the modulator output by $\omega_m$ as suggested by Chowning in his article, the modulator output instead passes through a first order highpass filter with a cutoff slope of 6 dB per octave. Such a cutoff slope means that for each octave of increase in modulator frequency, the amplitude is doubled.

As will be evident to those skilled in the art, this highpass filtering operation is in principle the same as multiplying each sinusoidal harmonic component of the oscillator output by its own frequency. Thus, it accomplishes the desired multiplication of each harmonic component of a spectrally rich waveform by the appropriate factor.

Accordingly, this invention can be used to implement the Chowning MUSIC V patch formula while eliminating the troublesome $\omega_m$ multiplication. It also allows for rapidly time varying modulator frequencies without the computational burden of frequent scaling of I(t). Finally, the present invention produces results audibly compatible with the Chowning formula, yet still requires only a single frequency input into the carrier phase increment oscillator. This combines the simplicity of true "frequency modulation," using a simple MUSIC V-type phase increment oscillator having a single frequency input, with the computational benefits of the "phase modulation" technique.

Various embodiments of the present invention are illustrated in FIGS. 1 through 10. These embodiments will first be described in terms of conventional signal flow diagrams.

Figure 1:
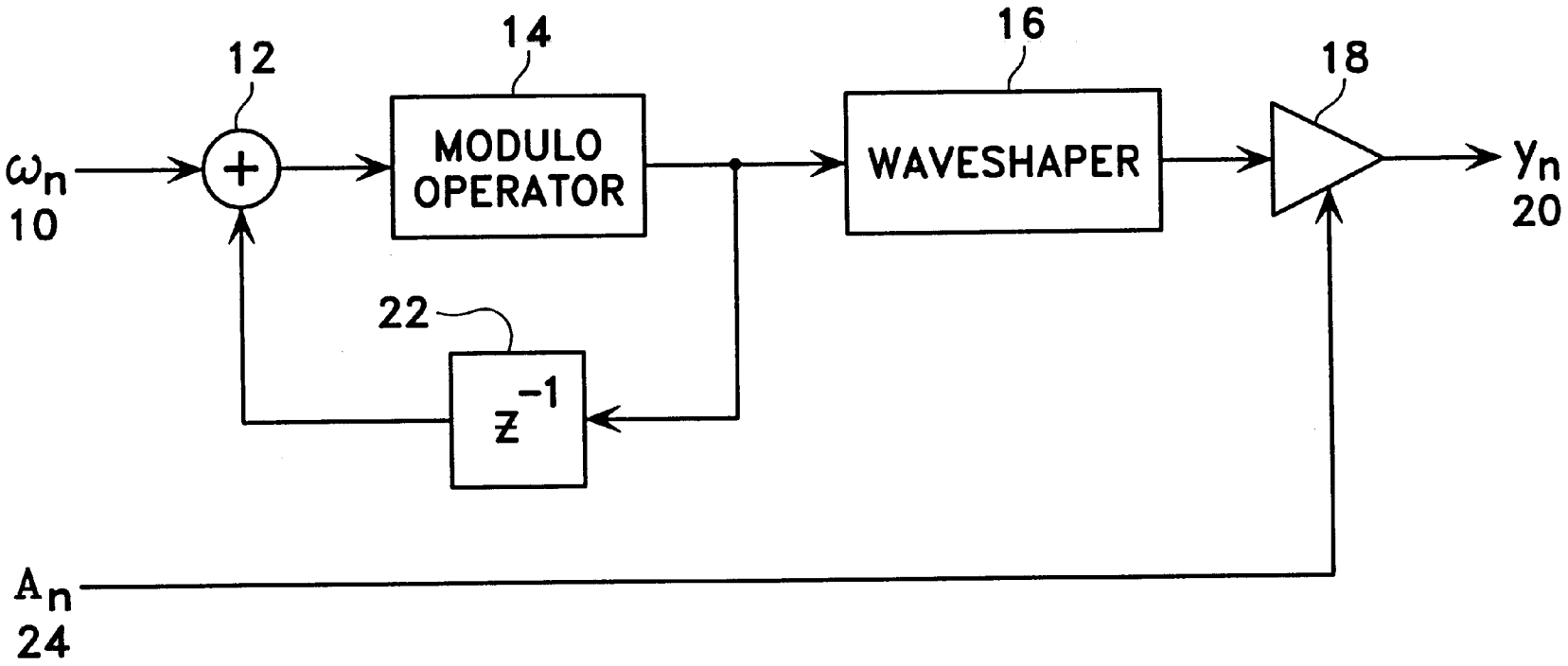
FIG. 1 shows a signal flow diagram of a known phase increment oscillator.
Figure 2A:
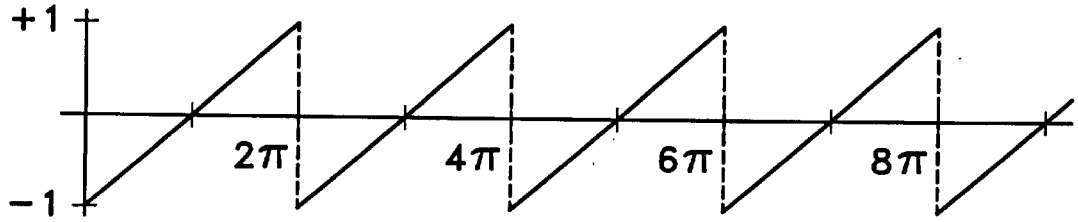
FIG. 2 shows graphically the basis for creating the eight standard "OPL3" waveforms using a waveshaping circuit based on quadratic splines.
Figure 2B:
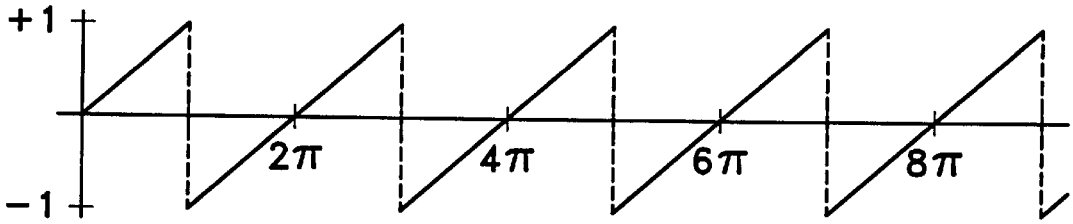
Figure 2C:
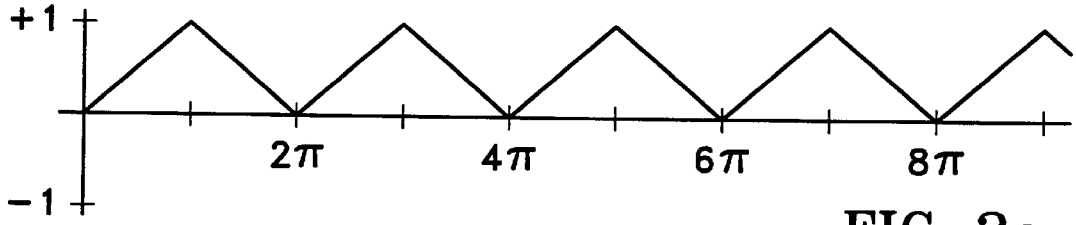
Figure 2D:
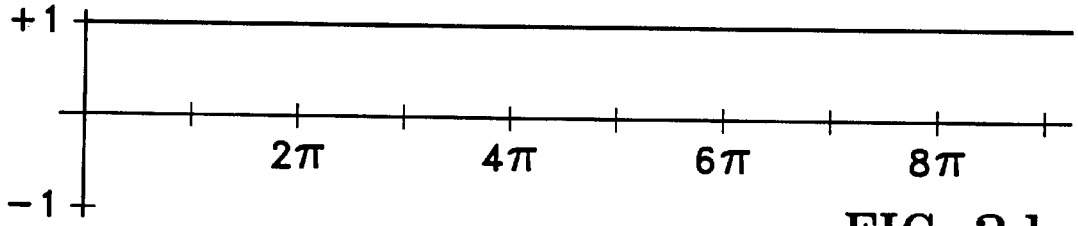
Figure 2E:
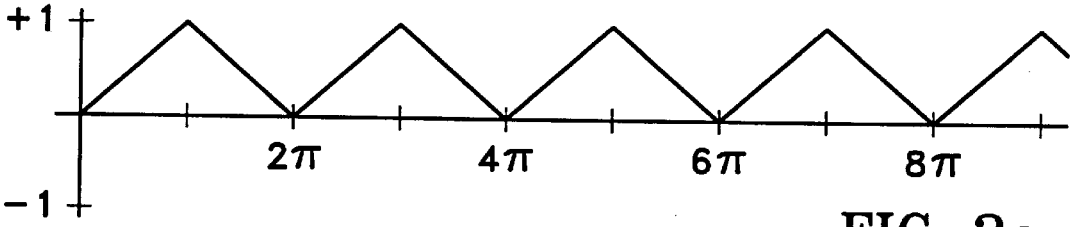
Figure 2F:
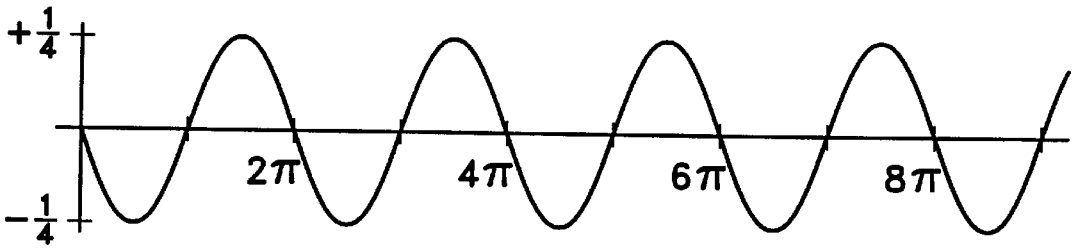

FIG. 1 shows a flow diagram for a simple phase increment oscillator. The actual MUSIC V oscillators, as well as those of most subsequent real-time synthesizers, were implemented as "phase increment" oscillators. While many variations of this oscillator exist, including in particular numerous connection topologies for implementing various FM patches, the fundamental core of the oscillator remains unchanged.

In a phase increment oscillator, a phase value is stored in a register or memory, and at each successive sample period it is incremented by a phase increment, which represents the instantaneous frequency of the oscillator. As will be easily seen by those skilled in the art, if the phase increment ($\omega_n$) input 10 is a constant much less than $2\pi$, the signal at the output of the modulo operator 14 will be a "sawtooth" waveform increasing slowly with constant slope from zero to $2\pi$, then jumping suddenly back to zero to begin rising again. Hence this signal is commonly referred to as a "phase sawtooth."

Although phase increment oscillators are often used to generate standard phase sawtooth signals by using a constant input, they can also accept time varying phase angle inputs. In either case, the resulting phase output can then be transformed into a sine waveform (or any other waveform) by a variety of techniques. In MUSIC V, for example, a lookup table was used to convert the phase sawtooth into a sine wave.

As is well known to those skilled in the art, phase increment oscillators can be implemented in a variety of ways. In MUSIC V, they were implemented as software running on a computer. In this specification, they are described as implemented in time division multiplexed circuitry. The scope of the present invention should not be limited to any particular implementation of a phase increment oscillator.

In the phase increment oscillator shown in FIG. 1, an adder 12 adds a phase increment ($\omega_n$) input 10 to the previous phase during each sample period. A modulo operator 14 takes the result modulo $2\pi$. A delay operator 22 then stores this new phase until the next sample period, in which the above steps are repeated. A waveshaping circuit 16 also receives this same phase signal, which it uses to produce the desired waveform.

As mentioned above, the waveshaping circuit 16 can be implemented using a ROM lookup table, and a variety of other techniques will also be evident to those skilled in the art. The waveshaping circuit 16 can be designed to produce whatever waveform is desired, sinusoidal or non-sinusoidal, from the output of the modulo operator 14.

One method of generating waveforms based on quadratic splines disclosed in co-pending patent application No. 08/682,383, filed on Apr. 7, 1995, can also be used to implement the waveshaping circuit 16 to generate the standard eight waveforms of the Yamaha Corporation "OPL3" synthesizer chip. That quadratic spline method is shown in FIGS. 2 through 5.

The quadratic spline method performs the function of the waveshaping circuit 16 in FIG. 1. FIG. 2 shows pictorially the generation, according to the quadratic spline method, of an inverted sine waveform. Although for clarity the example of a standard phase sawtooth being input to the waveshaping circuit 16 is sometimes used in the detailed description of the quadratic spline method, it will be evident to those skilled in the art that the phase angle input need not be limited to a standard phase sawtooth; any phase angle input may be used.

Row 2*a* of FIG. 2 shows several cycles of the standard phase sawtooth, with time varying over the horizontal axis and amplitude varying from −1 to +1 on the vertical axis. Note that the vertical axis has been scaled and a fixed offset added to the standard view of the phase sawtooth varying from 0 to $2\pi$; this is of course of no audible consequence.

Row 2*b* shows the standard phase sawtooth with a phase offset of $\pi$ added to it. In other words, the phase sawtooth has been shifted 180 degrees along the horizontal axis. Row 2*c* shows the absolute value of the signal in FIG. 2*b*. Row 2*d* shows the signal, in this case simply y(t)=1, which according to the quadratic spline method is to be ANDed with Row 2*c*. Row 2*e* shows the results of that ANDing. Finally, Row 2*f* shows the end results of the quadratic spline method, obtained by multiplying the signal in Row 2*a* with that in Row 2*e*, which can be seen to approximate an inverted sine waveform of amplitude ranging from −¼ to ¼. This is an inverted form of the first standard "OPL3" waveform, obtained according to the quadratic spline method.

Figures 3A, 3B, 3C, 3D, 3E, 3F:
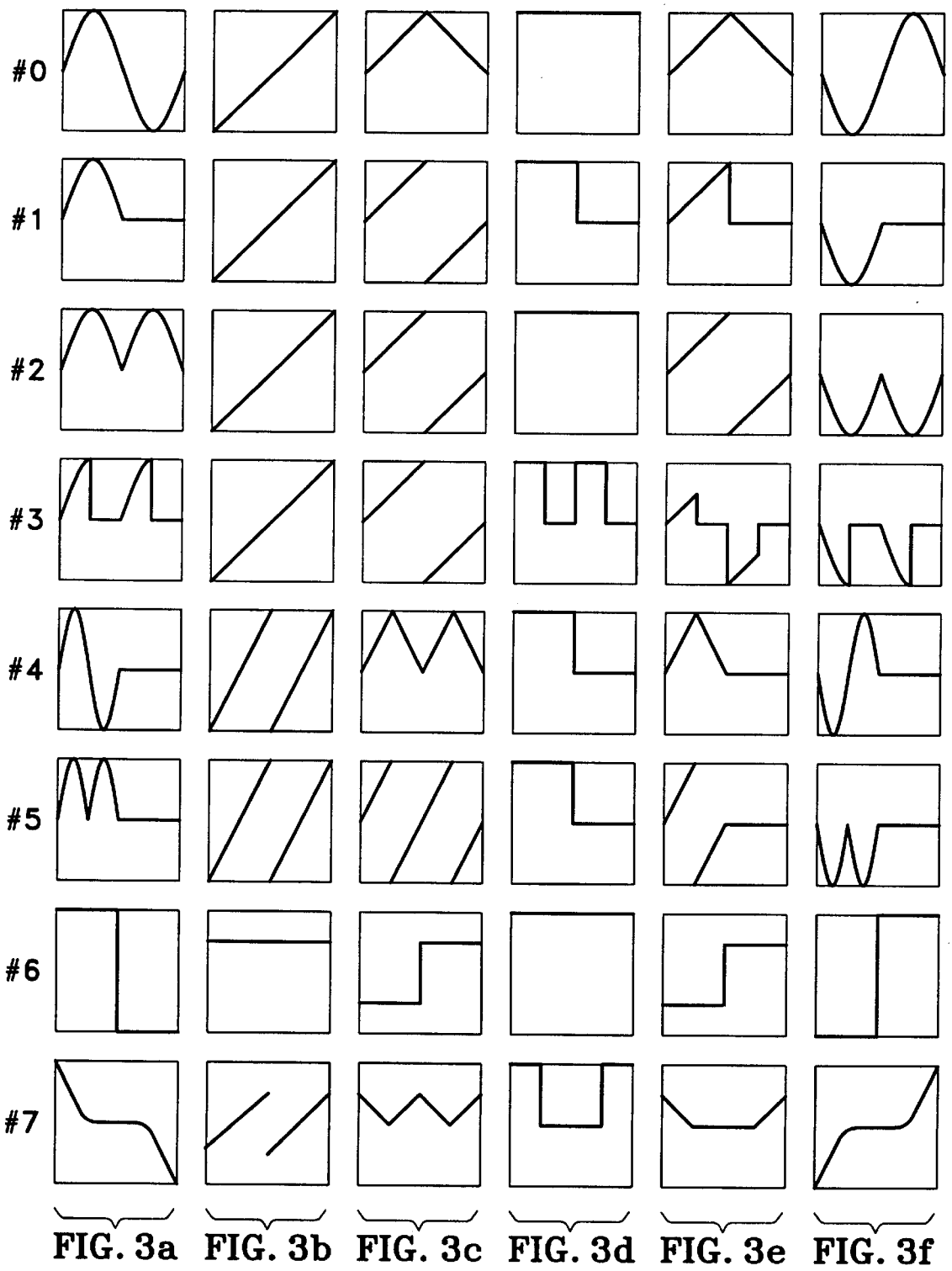
FIG. 3 shows graphically the creation of the eight standard "OPL3" waveforms using a waveshaping circuit based on quadratic splines.

FIG. 3 shows pictorially the method, according to the quadratic spline method, for forming each of the eight standard "OPL3" waveforms (Waveforms #0 to #7). Each of the steps of the method shown pictorially in FIG. 3 will be discussed in greater detail below when describing the operation of the hardware embodiment of the quadratic spline method.

Column 3*a* of FIG. 3 shows one cycle, from $\pi$ to $+\pi$, of each of the eight waveforms. Column 3*b* shows the first modification, if any, to the input phase sawtooth required by the quadratic spline method. This first modification results in either the original phase sawtooth (for Waveforms #0 to #3), the original phase sawtooth doubled in frequency (for Waveforms #4 and #5), and in one case, also halved in amplitude (for Waveform #7), or the signum of the original phase sawtooth, also halved in amplitude (for Waveform #6).

Column 3*c* shows the modified phase sawtooth shifted in phase, if required, and its absolute value taken, if required, in both cases according to the quadratic spline method. Column 3*d* shows the function which, according to the quadratic spline method, is ANDed with the modified phase sawtooth of column 3*c*, and column 3*e* shows the results of the ANDing of columns 3*c* and 3*d*. Finally, column 3*f* shows the results of the final step of the quadratic spline method, multiplying column 3*b* by column 3*e*. Note that the vertical scale of column 3*e* is from −¼ to ¼, while the vertical scale of the other columns is −1 to 1.

From FIG. 3, it can be seen that all eight standard "OPL3" waveforms can be approximated according to the quadratic spline method. This is accomplished by appropriately combining, according to the quadratic spline method, the steps of modifying the original phase sawtooth input, shifting the result in phase, taking an absolute value, ANDing the result with certain phase sawtooth bits, and finally a single multiplication. Note that the polarity of the approximated waveforms is treated as being insignificant, as it does not affect the sound or harmonic content of the waveform. However, as will be seen below, with minor modifications to the circuitry described even the polarity can be corrected, if desired.

Figure 4:
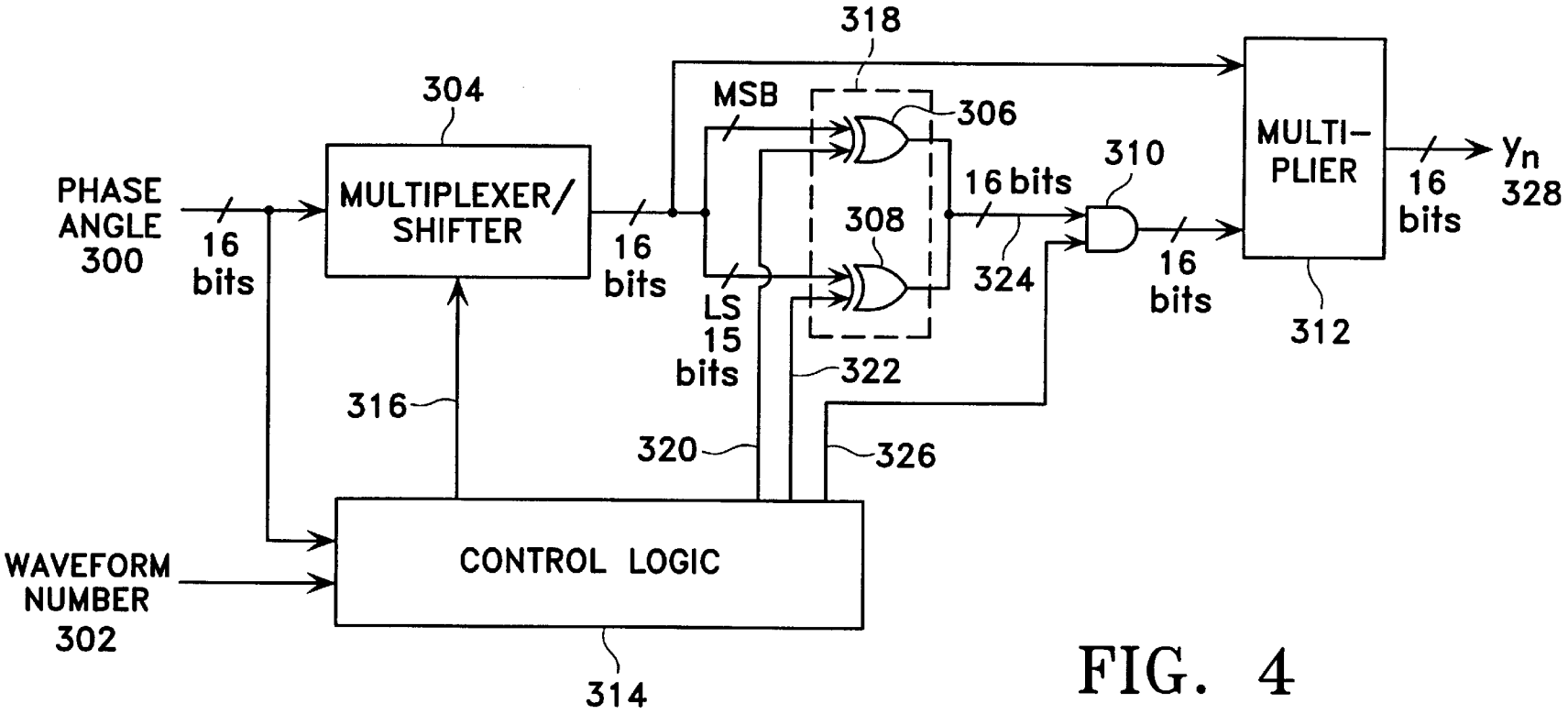
FIG. 4 shows a block diagram of a hardware implementation of a waveshaping circuit based on quadratic splines.

FIG. 4 shows a detailed hardware implementation of the quadratic spline method. A phase angle input 300 provides an input to both a multiplexer/shifter 304 and control logic 314.

The multiplexer/shifter 304 is a multiplexer wired as a modified barrel shifter. The control logic 314 drives the multiplexer/shifter 304 through a control signal 316. In this embodiment, the control signal has two bits for representing the four possible multiplexer/shifter functions. However, as will be evident to those skilled in the art, the control signal 316 can have more than two bits if desired to optimize the logic of the circuit.

The steps for generating each of the standard "OPL3" waveforms will now be described. First, the multiplexer/shifter 304 operates on the phase angle input 300, as described in detail below. The output signal of the multiplexer/shifter 304 for each waveform is shown in column 3*b* of FIG. 3.

In FIG. 4, when the control logic 314 sends a control signal 316 of binary 00 to the multiplexer/shifter 304, the multiplexer/shifter 304 outputs a 16-bit signal identical to the 16-bit phase angle input 300 it received. This produces the output signal shown in rows #0 to #3 of column 3*b* of FIG. 3.

When the control signal 316 to the multiplexer/shifter 304 is binary 01, it shifts the 16-bit phase angle input 300 left one bit, shifts off and ignores the most significant bit ("MSB"), sets the new least significant bit ("LSB") to 0, and inverts the new MSB. Mathematically, this is equivalent to adding $\pi/2$ to the phase angle input 300, multiplying the result by two, and then taking the result modulo $2\pi$. This produces the output signal shown in rows #4 and #5 of column 3*b*.

When the control signal 316 to the multiplexer/shifter 304 is binary 10, it outputs a fixed hexadecimal 3FFF. This produces the output signal shown in row #6 of column 3*b*.

Finally, when the control signal 316 to the multiplexer/shifter 304 is binary 11, it outputs the fourteen LSBs of the 16-bit phase angle input 300 unchanged, and sets the two MSBs of the output signal both to the inverse of the next to the most significant bit, i.e. bit 14, of the original input signal. In other words, it outputs the fifteen LSBs of the 16-bit phase angle input 300 plus $\pi/2$, sign extended. This produces the output signal shown in row #7 of column 3*b*.

Next, a bank 318 of exclusive OR gates further modifies the 16-bit output signal of the multiplexer/shifter 304. The exclusive OR bank 318 consists of two sections. The first section of exclusive OR gates 306 acts only on the MSB of the multiplexer/shifter 304 output signal, while the second section of exclusive OR gates 308 acts on the other fifteen LSBs.

The exclusive OR bank 318 performs two functions, phase shifting and a functional approximation to the absolute value function, or a combination of both, or neither (a pass-through). The output signal of the exclusive OR bank 318 for each waveform is shown in column 3*c* of FIG. 3.

When two control signals 320 and 322 received by both sections of the exclusive OR bank 318 are both a logical "0", no change occurs. This pass-through operation is used to produce part of the output signal shown in rows #6 and #7 of column 3*c* of FIG. 3.

When the first control signal 320 is logical "0" and the second control signal 322 is logical 11111, the output signal 324 of the exclusive OR bank 318 is the one's complement of the multiplexer/shifter 304 output signal plus $\pi$. In this case, the one's complement is only one LSB away from the two's complement, which is, to the accuracy required, the same result as obtained by multiplying by −1. Accordingly, taking the one's complement can be used to produce a functional approximation to the absolute value function. This phase-shifting and absolute value operation is used to produce part of the output signal shown in rows #0 and #4 of column 3*c*.

When the first control signal 320 is a logical "1" but the second control signal 322 is a logical "0", the output signal 324 of the exclusive OR bank 318 is the sum of the multiplexer/shifter 304 output signal and $\pi$, since the MSB has significance $\pi$. Accordingly, this operation can be used to shift a signal by $\pi$. This operation is used to produce all of the output signal shown in rows #1, #2, #3 and #5 of column 3*c*, and part of the output signal shown in rows #0 and #4.

When the two control signals 320 and 322 are both a logical "1", the output signal 324 of the exclusive OR bank 318 is the one's complement of the output signal of the multiplexer/shifter 304. As discussed above, this operation is a functional approximation to the absolute value function. This operation is used to produce part of the output signal shown in rows #6 and #7 of column 3*c* of FIG. 3.

Next, a bank 310 of AND gates further modifies the 16-bit output signal 324 of the exclusive OR bank 318. A control signal 326 to the AND bank 310 can force its 16-bit output signal to hexadecimal 0000, or leave it unchanged. This performs the ANDing of each of the signals shown in column 3*c* of FIG. 3 with the corresponding signal shown in column 3*d*, with the output signal of the bank 310 for each waveform shown in column 3*e*.

It should be noted that all of the Boolean logic described up to this point is parallel in nature, and does not require any addition operations or other logic, such as a carry chain, that requires each higher order bit to be processed as a result of logical operations on lower order bits. Thus, the processing of this data involves only a few gate delays and can be accomplished within a single clock cycle.

A 16-bit by 16-bit signed two's complement multiplier 312 then receives both the 16-bit output signal of the multiplexer/shifter 304, unmodified (as shown in column 3*b* of FIG. 3), and the 16-bit output signal of the AND bank 310 (as shown in column 3*e*), and multiplies them together. Because most current audio applications use just 16-bit signals, only the sixteen MSBs of the multiplier 312 output signal are needed, so an abbreviated form of the multiplier can be used. The results of this multiplication for each waveform are shown in column 3*f* of FIG. 3. This completes the processing needed to form each of the standard "OPL3" waveforms.

As will be evident to those skilled in the art, depending on the size of the available multiplier, it may be desirable to have either or both of the arguments of the multiplier be less than 16 bits, since that would have only a minor impact on the waveform fidelity. Moreover, it will also be evident that any type of multiplier could be used, such as a full parallel multiplier, a serial multiplier, or a hybrid parallel/serial multiplier, to accomplish this function.

In addition, the multiplier 312 output signal never reaches more than one fourth of its theoretical maximum output value, since the peak values occur when its inputs are each at an absolute value of half of full scale. The multiplier 312 output signal 328 should be scaled to account for this.

As is evident from the above step-by-step description, the four control signals 316, 320, 322 and 326 output by the control logic 314 must be set appropriately to form the eight "OPL3" waveforms. These control signals 316, 320, 322 and 326 are determined by the waveform number 302 and the two MSBs of the phase angle input 300. These control signals 316, 320, 322 and 326 then appropriately control the multiplexer/shifter 304, the exclusive OR bank 318, the AND bank 310 and the multiplier 312 to create the desired waveform from the phase angle input 300.

Based on the waveform number 302 and bits 15 and 14 of the phase angle input 300, the control logic 314 sets the control signals 316, 320, 322 and 326 to the values shown in the truth table, Table 1, below. In Table 1, PHn indicates the nth bit of the phase angle input 300, so that, for example, PH15 is the most significant bit. ! indicates logical complement, and ^indicates an exclusive OR.

TABLE 1

Control Signal Truth Table

| Waveform | Control Signals: | | | |
|---|---|---|---|---|
| Number | 316 | 320 | 322 | 326 |
| #0 | 00 | PH15 | !PH15 | 1 |
| #1 | 00 | 1 | 0 | PH15 |
| #2 | 00 | 1 | 0 | 1 |
| #3 | 00 | 1 | 0 | !PH14 |
| #4 | 01 | !PH14 | PH14 | PH15 |
| #5 | 01 | 1 | 0 | PH15 |
| #6 | 10 | PH15 | PH15 | 1 |
| #7 | 11 | !PH14 | !PH14 | PH15^PH14 |

Figures 5A, 5B, 5C, 5D:
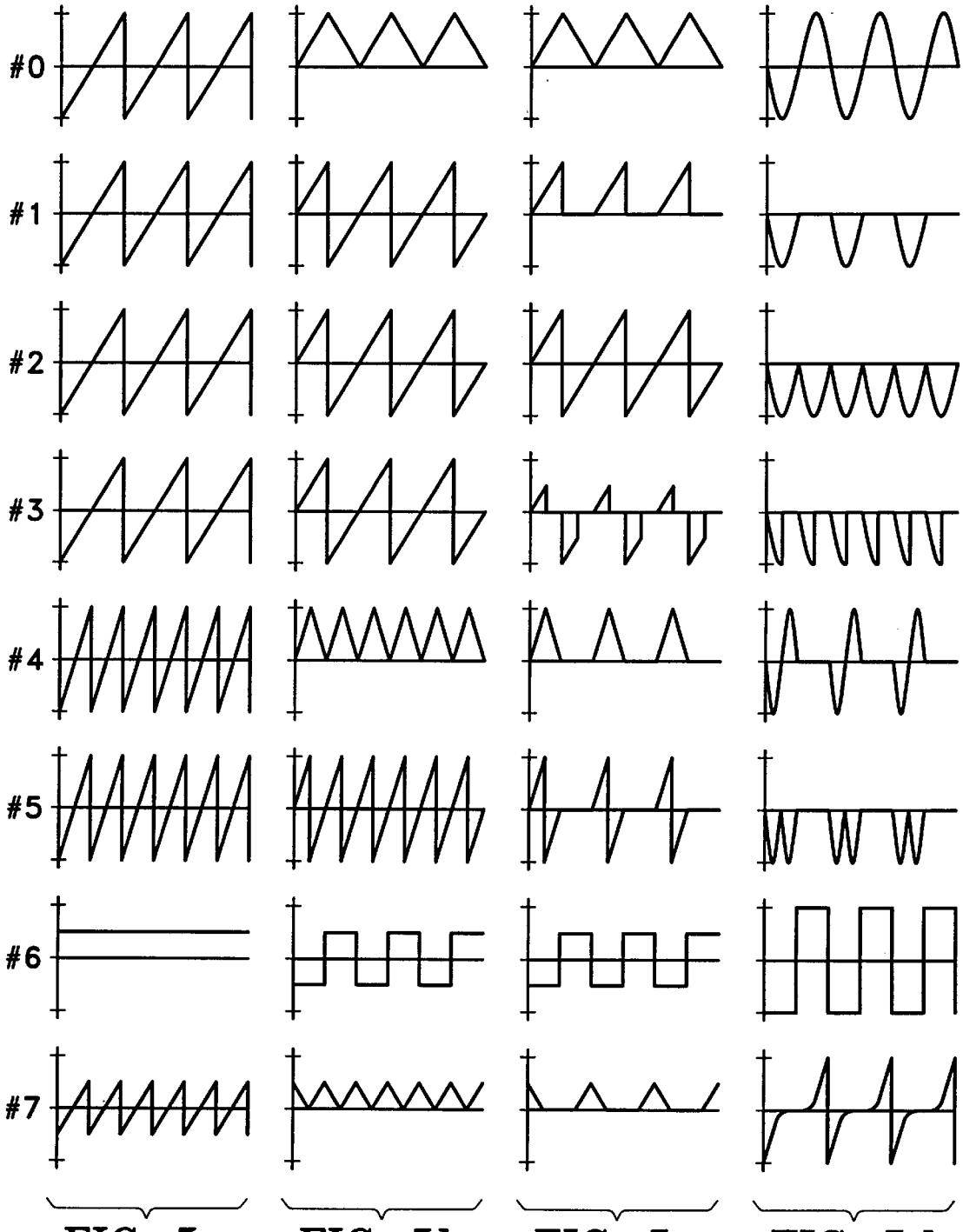
FIG. 5 shows the relationship of signals in a waveshaping circuit based on quadratic splines for the eight "OPL3" waveforms.

FIG. 5 shows in graphical form the various steps, described in detail above, for producing each of the eight "OPL3" waveforms. Column 5*a* shows the output signal of the multiplexer/shifter 304, column 5*b* shows the output signal 324 of the exclusive OR bank 318, column 5*c* shows the output signal of the AND bank 310, and column 5*d* shows the output signal 328 of the multiplier 312. Note that the vertical scale of column 5*d* is from −¼ to ¼, while the vertical scale of the other columns is −1 to 1.

As can be seen in column 3*f* of FIG. 3 and column 5*d* of FIG. 5, all of the output waveforms, when created as described above, are simply inverted in polarity from the desired "OPL3" waveforms. Inverted polarity has no audible impact on the sounds of these waveforms. However, the precise waveform, correct in phase and polarity, can be produced by taking the complement of the output waveform. This can be done at a variety of locations in further signal processing circuitry, as part of the multiplier 312, or by an additional circuit. As will be evident to those skilled in the art, a one's complementing of the output signal may be sufficient to accomplish this inversion to the accuracy of the approximations herein described.

FIG. 4 provides circuitry, or hardware, which embodies the quadratic spline method. However, as will be evident to those skilled in the art, the quadratic spline method can also be embodied in firmware and software.

As can be seen from the detailed description of the quadratic spline method above, it enables each of the standard "OPL3" waveforms to be produced without requiring large amounts of memory or intensive computation. However, as will be evident to those skilled in the art, it does suffer from approximately 2% harmonic distortion. Accordingly, for applications where the waveform can be an approximation, and high accuracy in the waveform is not required, the waveshaping circuit of the quadratic spline method provides advantages over other methods.

Returning to the description of FIG. 1, once the waveshaping circuit 16 of FIG. 1 has produced its output, multiplier 18 then multiplies the waveshaping circuit 16 output by an amplitude ($A_n$) input 24 to produce an audio signal ($Y_n$) output 20 of the desired amplitude and frequency. As will be evident to those skilled in the art, the phase increment ($\omega_n$) input 10 can be time varying. The amplitude ($A_n$) input 24 can also be time varying, in ways that will be evident to those skilled in the art, to achieve amplitude envelope characteristics such as attack and decay.

Figure 6:
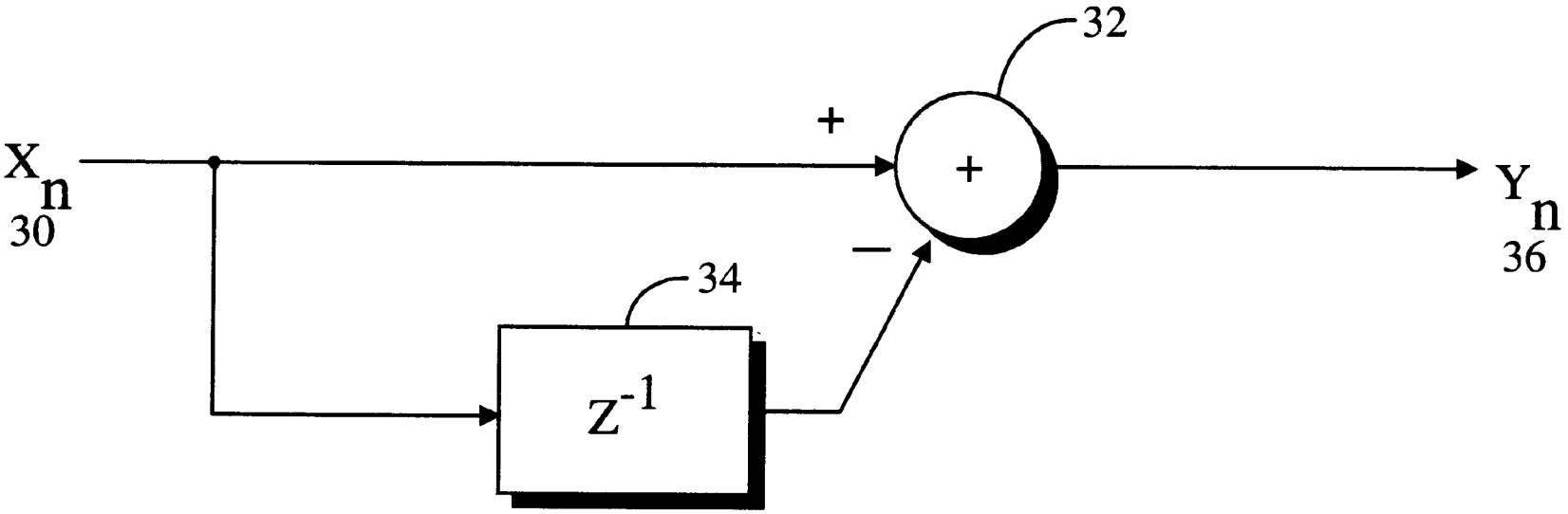
FIG. 6 shows a signal flow diagram of a known first order FIR highpass filter.

FIG. 6 shows a flow diagram for a first order FIR highpass filter, which has been known to those skilled in the art for many years. These and other filters are summarized in the April 1985 article "Introduction to Filter Theory," Report No. STAN-M-20 (Stanford University, Center for Computer Research in Music and Acoustics) by Julius O. Smith, reprinted in *Digital Audio Signal Processing: An Anthology,* edited by John Strawn.

In the filter of FIG. 6, the delay operator 34 delays the signal ($X_n$) input 30 by one sample period. A subtractor 32 then subtracts the delayed input from the original signal input 30, resulting in a highpass filtered output ($Y_n$) 36. Note that this simple highpass filter involves only one addition and no multiplications. Because of its simplicity, it can be cheaply implemented. However, as will be evident to those skilled in the art, a variety of other filters can be used.

Figure 7:
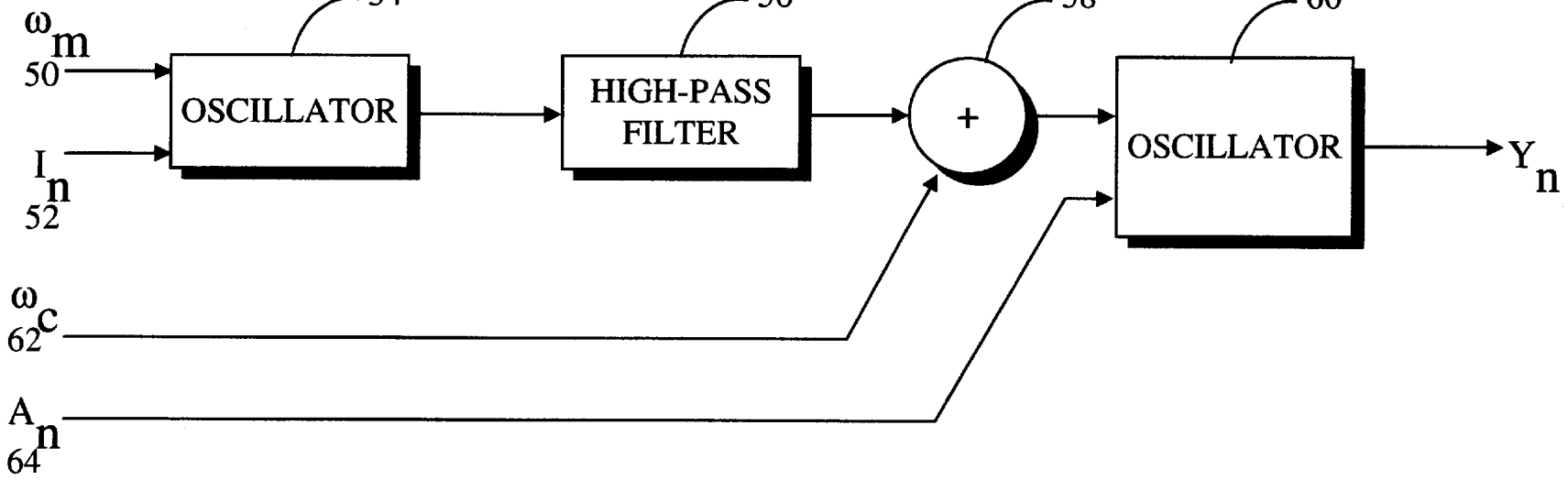
FIG. 7 shows a signal flow diagram of an embodiment of the present invention.

FIG. 7 shows a flow diagram for an embodiment of the present invention. In this flow diagram, phase increment oscillators like that shown in FIG. 1 and a highpass filter like that shown in FIG. 6 are both used. A modulation phase increment oscillator 54 like that of FIG. 1 receives a modulator phase increment ($\omega_m$) input 50 and a time varying modulation index ($I_n$) input 52 and produces an audio rate modulator waveform output. To take a simple example where $\omega_m$ is a constant and the modulation phase increment oscillator 54 is configured to produce a simple sinusoidal waveform, then the output of the modulation phase increment oscillator 54 is, approximately, $I(t)\sin(\omega_m t)$.

A highpass filter 56 like that of FIG. 6 then filters this output, which effectively multiplies it by its component frequencies. In the simple example given above, the output of the highpass filter 56 is, approximately, $I(t)\omega_m\sin(\omega_m t)$.

Next, an adder 58 then sums the output of the highpass filter 56 with a carrier phase increment ($\omega_c$) input 62. In the simple example given above, the output of the adder is, approximately, $\omega_c+I(t)\omega_m\sin(\omega_m t)$ Finally, a carrier phase increment oscillator 60, also like that of FIG. 1, receives the sum from the adder 58 and a time varying amplitude ($A_n$) input 64, and produces an audio output from them. That audio output is a signal representing a musical sound, produced by FM synthesis. In the simple example given above, assuming that the carrier phase increment oscillator 60 is configured to produce a simple sinusoidal waveform, its output is, approximately, $A(t)\sin([\omega_c+I(t)\omega_m\sin(\omega_m t)]t)$. As can be seen from Equation (2) above, mathematically this example approximates the same results as Chowning's MUSIC V patch.

If desired, any or all of the modulation phase increment oscillator 54, the highpass filter 56, the carrier phase increment oscillator 60 and the adder 58 can be designed to utilize the same adder circuitry by using time division multiplexing. As those skilled in the art will recognize, although this may decrease the number of logic gates needed, it will probably be at the expense of the speed and efficiency of the circuit. Accordingly, this tradeoff should be considered in designing a circuit of the present invention.

As will also be evident to those skilled in the art, the entire circuit of FIG. 7 can be time division multiplexed. Here again, however, there may be a tradeoff between a reduction in the number of logic gates required and the levels of speed and efficiency that can be obtained.

Finally, as mentioned above, the phase increment inputs to a phase increment oscillator can be time varying. Accordingly, in the circuit of FIG. 7, either or both of the modulator phase increment ($\omega_m$) input 50 and the carrier phase increment ($\omega_c$) input 62 can be time varying.

Figure 8:
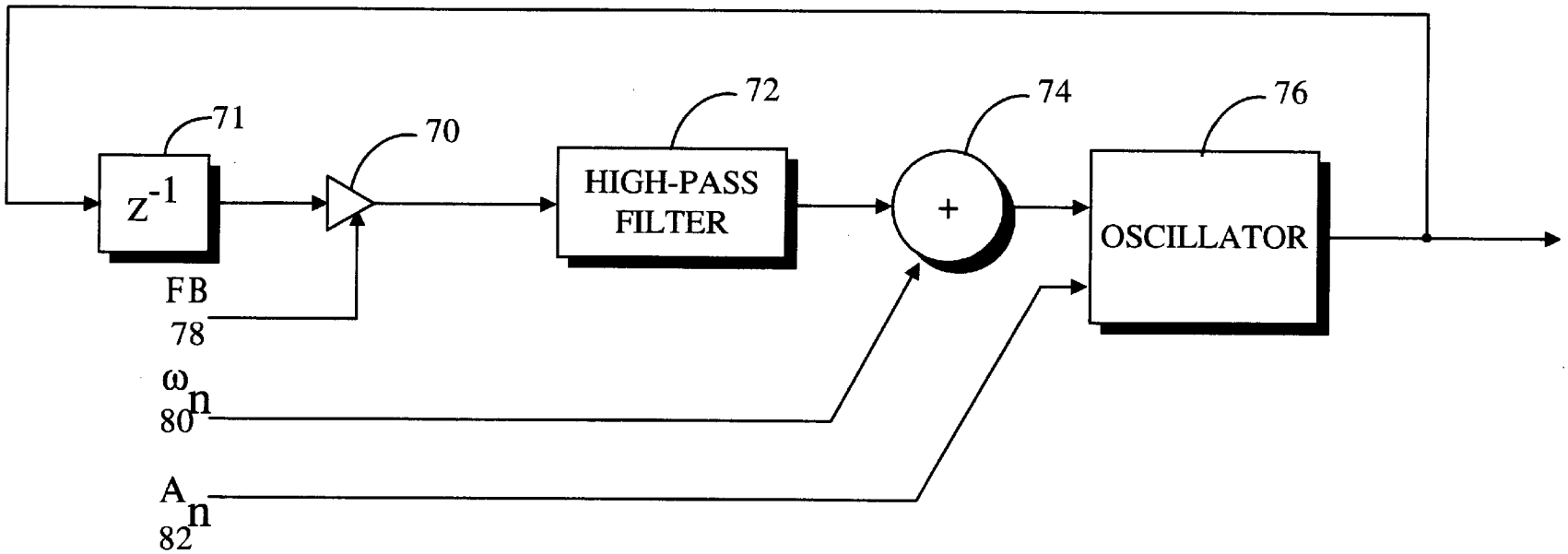
FIG. 8 shows a signal flow diagram of the present invention in self-modulated form.
Figure 9:
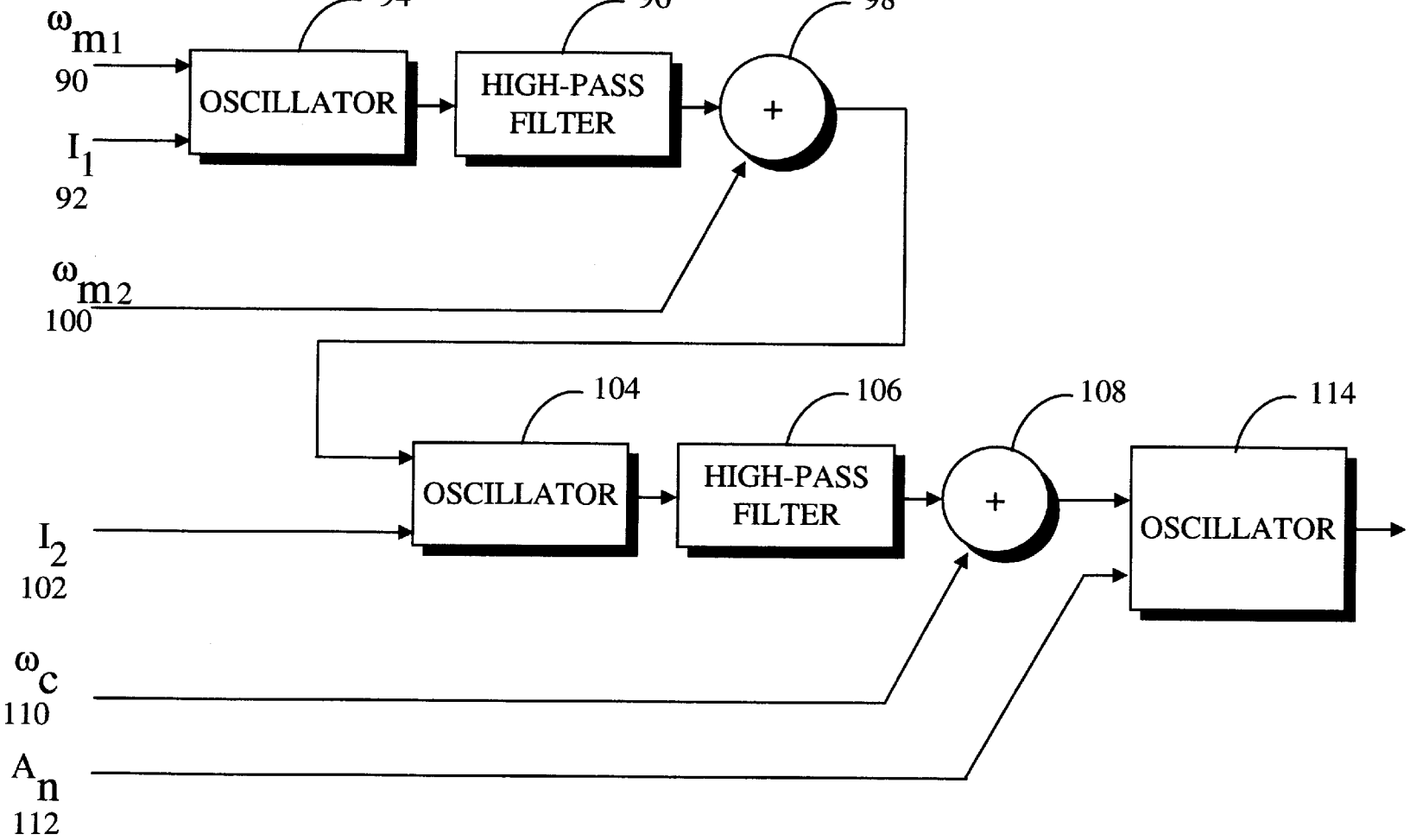
FIG. 9 shows a signal flow diagram of the present invention in cascaded form.

FIGS. 8 and 9 show additional variations of the present invention in flow diagram form. FIG. 8 shows "self-modulation". In this case, the same oscillator serves as both the modulation and carrier phase increment oscillators, and the same $\omega_n$ serves as both the modulation and carrier phase increments.

In FIG. 8, a phase increment oscillator 76 receives an amplitude ($A_n$) input 82 and a phase increment input, and produces an audio output from them. The phase increment input to the phase increment oscillator 76 is obtained by feeding the output of the phase increment oscillator 76 back into the circuit, once it has been delayed by a delay operator 71. That same audio output is also used as a signal representing a musical sound, produced by FM synthesis. As self-modulation in FM synthesis is well known, it will be evident to those skilled in the art how the present invention can be implemented in a self-modulation topology.

When the output of the phase increment oscillator 76 is fed back into the circuit, it must be delayed at least one unit by the delay operator 71 to avoid the circuit being an endless loop. A feedback shifter 70 (a shifter is a fixed multiplier by $2^n$) is then used, by varying a feedback input 78, to produce a signal of the desired magnitude.

A highpass filter 72 then filters the signal, after which an adder 74 then adds the output of the highpass filter 72 to the current value of the phase increment ($\omega_n$) input 80. This sum is then used as the first phase increment ($\omega_n$) input of the phase increment oscillator 76, completing the self modulation loop.

FIG. 9 shows multiple cascaded FM oscillators. A first phase increment oscillator 94 receives a first modulator frequency ($\omega_{m1}$) input 90 and a first modulation index ($I_1$) input 92, and produces from them an output, which it then passes on to a first highpass filter 96. A first adder 98 adds the output of the first highpass filter 96 to a second modulator frequency ($\omega_{m2}$) input 100.

A second phase increment oscillator 104 then continues the cascaded modulation by receiving the sum from the first adder 98 and a second modulation index ($I_2$) input 102. A second highpass filter 106 filters the output of the second modulation oscillator 104, after which a second adder 108 adds it to a carrier frequency ($\omega_c$) input 110.

Finally, a third phase increment oscillator 114 produces an audio output from the sum from the second adder 108 and an amplitude ($A_n$) input 112. That audio output is a signal representing a musical sound, which has been modulated by two modulation frequencies. Expressed as a formula, in a simple example where $\omega_c$, $\omega_{m1}$ and $\omega_{m2}$ are all constants, and the three phase increment oscillators 94, 104 and 114 are all configured to produce simple sinusoidal waveforms, the audio output is, approximately:

$$A(t)\sin([\omega_c+I_1(t)\omega_{m1}\sin([\omega_{m1}+I_2(t)\omega_{m2}\sin(\omega_{m2}t)]t)]t)$$

As will be evident to those skilled in the art, this type of cascading can be used to produce particularly complex and spectrally rich waveforms. As will also be evident to those skilled in the art, cascading can be done with as many levels as desired simply by adding modulation phase increment oscillators, adders and highpass filters. In fact, since a single adder can be used to perform all the additions for the entire circuit by using time division multiplexing, in that case only pairs of modulation phase increment oscillators and highpass filters need be added to add another level of cascading.

These flow diagrams show examples of how the present invention can be applied in a variety of FM topologies. As will be evident to those skilled in the art, they can be combined in further arbitrary and complex ways to produce a variety of modulated waveforms.

Figure 10:
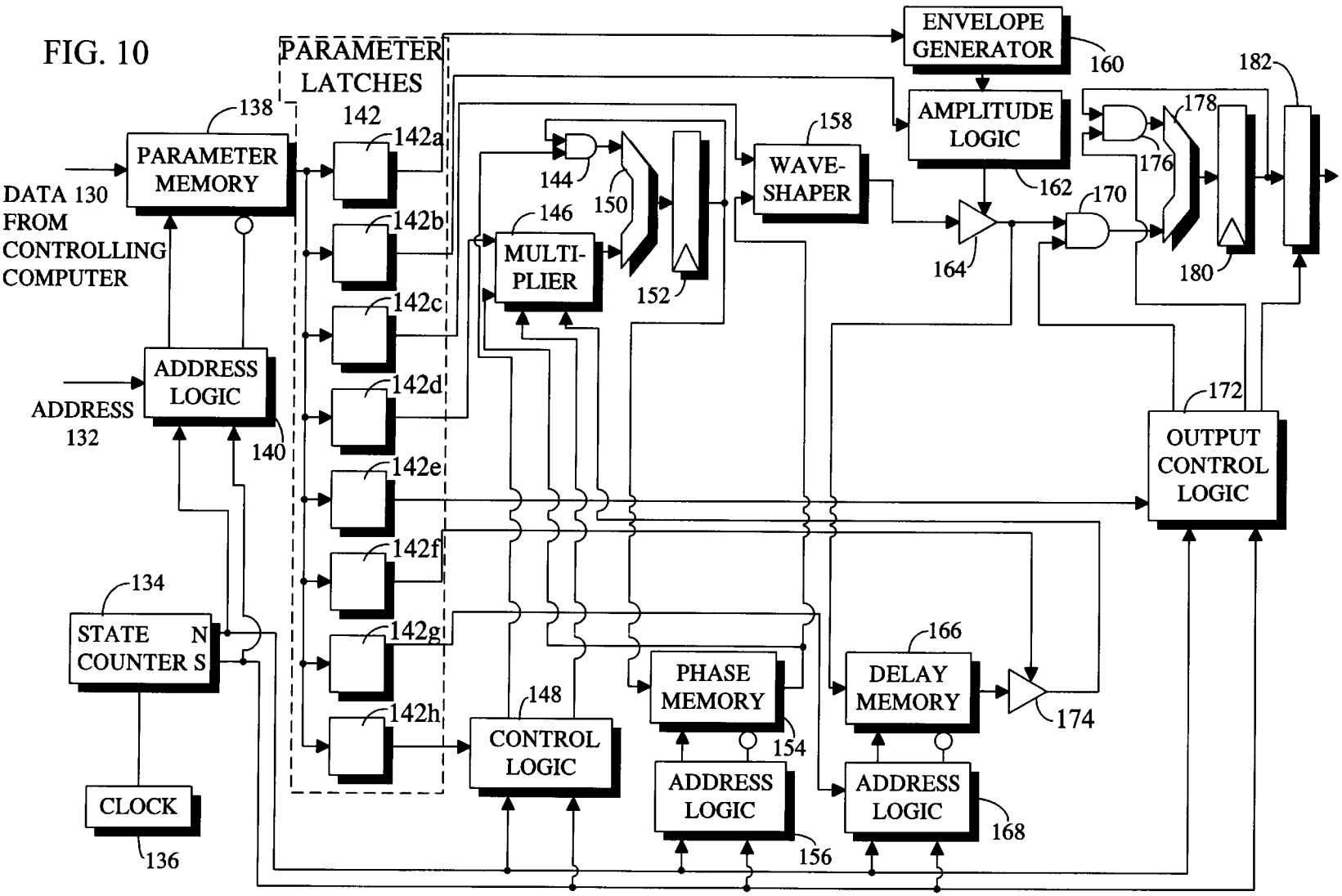
FIG. 10 shows a block diagram of the present invention implemented in multichannel real time hardware.

FIG. 10 shows a functional block diagram of a multichannel real time hardware implementation of the present invention which supports many oscillators, selectively interconnected. In this embodiment, the circuitry operates using time division multiplexing at both the oscillator and state level.

Using multiplexing at the oscillator level means that rather than implementing each of the oscillators as circuitry, the oscillators are each implemented in "virtual circuitry" by accessing their parameters, when needed from a parameter memory 138. As is evident to those skilled in the art, the oscillators could easily be implemented in other ways, such as by "hardwiring" each oscillator so that each has its own dedicated circuitry. The tradeoff between different implementations is usually between simplicity of the circuit and speed and efficiency of the circuit's operation.

Because this implementation does not limit the number of oscillators used, several levels of modulation can be cascaded. However, the simplest case is when only two oscillators are used, one a modulation phase increment oscillator and one a carrier phase increment oscillator. In describing the operation of this implementation, that simple case of only two oscillators will be used, which is shown as a signal flow diagram in FIG. 7. In addition, the description below also assumes that $\omega_c$ and $\omega_m$ are both constants and that the two oscillators are both configured to produce simple sinusoidal waveforms. However, it should be noted that the present invention also allows other waveforms to be used. The choice of waveform is limited, if at all, only by the configuration of the waveshaping circuit 158 that is implemented.

The operation of FIG. 10 will now be described using the simple example set forth above. First, a clock generator 136 provides the basic clock for the circuit. The clock generator 136 produces a clock signal at KS times the sample rate, where K is the number of oscillators to be implemented (in this example K=2) and S is the number of clocks or states per oscillator. As is evident to those skilled in the art, K and S are limited for a given sample rate by the speed of the logic and memories.

The clock generator 136 drives a state counter 134, which consists of two sections. The least significant portion of the state counter 134 divides the processing period of each oscillator into S states, one per clock pulse. The most significant portion of the counter provides a count of the virtual oscillator being processed. In the simple example being described here, only a single bit is needed to count the two oscillators. An overflow of the counter indicates the completion of a sample period.

The circuit of FIG. 10 contains three memories. First, a parameter memory 138 contains the controlling parameters for both of the oscillators. These parameters can include such data as the phase increments (both for the modulator and the carrier), amplitudes, envelope time constants and key-on signals, vibrato and tremolo amounts, waveform type and interconnection information for the oscillators. A controlling computer or microprocessor can write this data to be responsive to the required musical notes, which can be generated by a keyboard in real time, by a computer sequencer or by other means. Each of these variables must be set by an application program in ways that are well-known to those skilled in the art.

Parameter memory address control logic 140 controls access to the parameter memory 138. Within the processing period for either oscillator, the various parameters will be accessed during different states and stored in the appropriate parameter latches 142 in time to be used by the computational circuitry for calculation of the current sample point for the current oscillator. The controlling computer or microprocessor writes new data into the parameter memory 138 via the data input 130 during states in which no fetch of parameter data is required, as determined by decoding the state S. During those states, parameter memory address logic 140 also sets the write address of the parameter memory 138 to the address of the parameter supplied by the controlling computer via address input 132.

There are two other memories in addition to the parameter memory 138. A phase memory 154 stores the phase, taken modulo $2\pi$, for both oscillators. A delay memory 166 stores two samples of the output of each of the two oscillators. The contents of both of these memories are used during the processing of the respective oscillators.

In FIG. 10, the parameter, phase and delay memories are shown as being separate. As will be evident to those skilled in the art, however, in certain implementations it may be advantageous to combine any or all of the parameter, phase and/or delay memories into one or more memory units.

The step-by-step operation of the circuit of FIG. 10 will now be discussed by describing the processing for a particular sample point by both the modulation (Oscillator 0) and carrier (Oscillator 1) oscillators. First, the processing for the new sample point by Oscillator 0, which is the modulation phase increment oscillator 54 of FIG. 7, will be described.

It should be noted that during the processing for each oscillator, the address logic 140 for the parameter memory 138 causes the eight parameters for the modulation oscillator to be accessed, based on a signal received from the state counter 134, and they are read into the appropriate parameter latches 142. This need not happen at one time, as long as each parameter latch is set at some point prior to when it is used. The contents of the various parameter latches 142*a* to 142*h*, and how they are used in the operation of the circuit, will be described below.

To generate Oscillator 0's phase for the new sample point, the cumulative phase for the previous sample point must be added to the phase increment. In the simple example being described here, this sum becomes the term $\omega_m t$. To compute this sum, the address logic 168 for the delay memory 166 causes the previous phase output for Oscillator 0 to be output, and it passes through a shifter 174, a multiplexer 146 and an adder/subtractor 150, none of which modify it, to a phase accumulator 152, in which it is stored.

Once this is completed, based on control parameters for Oscillator 0 contained in the eighth parameter latch 142*h*, the control logic 148 causes the multiplexer 146 to access the phase increment for Oscillator 0, which in the simple example being described here is $\omega_m$, from the fourth parameter latch 142*d*. The multiplexer 146 then passes the phase increment ($\omega_m$) on as one input to the adder/subtractor 150, while at the same time the control logic 148 and a bank of AND gates 144 cause the previous phase that is stored in the phase accumulator 152 to be passed as the other input to the adder/subtractor 150, which adds the two quantities.

Note that this addition can be performed modulo $2\pi$, which scales the size of the phase accumulator word to $2\pi$. The result of this addition is the new phase for Oscillator 0, or $\omega_m t$ for the new sample point, which is then stored back into the phase memory 154.

Next, $\sin(\omega_m t)$ must be calculated. This is done by a waveshaping circuit 158, which obtains the phase for Oscillator 0 from the phase memory 154 and transforms it into the desired waveform according to the waveshape parameters contained in the third parameter latch 142*c*. In the simple example being described here, the output of the waveshaping circuit 158 is $\sin(\omega_m t)$ for the new sample point.

Although the phase incrementing operation described above and the waveshaping operation are described as occurring in sequence, it may be a more optimal design of the circuit to have the two operations occur simultaneously, so that two sample points are being processed by the circuit at one time. By carrying out these two operations in parallel, rather than sequentially, the speed of the circuit is optimized. However, this will be at the expense of the more complex control scheme required to enable parallel operation.

An envelope generator 160 then obtains information about the key state (on or off) and the attack, decay, sustain and release parameters from the first parameter latch 142*a*, and computes the current envelope value for Oscillator 0. An amplitude logic block 162 takes this current envelope value, obtains amplitude parameters stored in the second parameter latch 142*b*, and computes from these values an amplitude for Oscillator 0 for the new sample point. An amplitude multiplier 164 then multiplies the output of the waveshaping circuit 158 by the amplitude. The output of the amplitude multiplier 164, which is $I(t)\sin(\omega_m t)$ in the simple example being described here, is then stored in the delay memory 166, replacing the twice previous output sample.

The remainder of the circuit enables the summing of the output of an oscillator with that of the previous oscillators for the same sample. This is done by output control logic 172, a bank of AND gates 176, and an adder 178. In addition, an accumulator 180 maintains the cumulative total of the outputs of all the oscillators. In the simple example being described here, these operations are not necessary, and this circuitry is not used. As will be evident to those skilled in the art, however, this circuitry can be used when several notes in a chord are being generated at the same time, with each note having its own set of modulation and carrier oscillators. In these cases, the results of several oscillators must be summed following the separate processing of the various oscillators or oscillator groups.

This completes the processing for the new sample point for Oscillator 0, and a similar process then begins for the carrier oscillator, Oscillator 1. However, because the output of Oscillator 0 must be highpass filtered and used by Oscillator 1, the processing for the new sample point for Oscillator 1 is somewhat more complex. Note that the parameters for Oscillator 1 must be read from the parameter memory 138 into the parameter latches 142, replacing the parameters for Oscillator 0, at some point prior to the time that Oscillator 1's parameters are accessed during the processing for Oscillator 1.

The processing for the new sample point by Oscillator 1 begins by highpass filtering the output of any modulation oscillator for Oscillator 1. The information latched in the seventh parameter latch 142*g*, determines which oscillator, if any, serves as the modulator for the carrier oscillator. In the simple example being described here, the seventh parameter latch 142*g* indicates that Oscillator 0 is a modulation oscillator for Oscillator 1.

As can be seen from the signal flow diagram of a highpass filter in FIG. 6, the highpass filtering of Oscillator 0's output requires the two most recent sample outputs of Oscillator 0. These two outputs are stored in the delay memory 166. When required during the processing described below, these two values are fetched from the delay memory 166 and input to the multiplexer 146.

If self-modulation is being done, a shifter 174 is provided to attenuate these delayed signals, if desired. Because the simple example being described herein does not include self-modulation, the shifter 174 is not used in this example. However, it will be evident to those skilled in the art how this shifter 174, which uses a feedback constant contained in the sixth parameter latch 142*f*, can be used to perform the self-modulation for which the signal flow diagram is shown in FIG. 8.

To generate the highpass filtered output of Oscillator 0 for the new sample point, the difference between the two previous sample outputs of the modulation oscillator, Oscillator 0, must be calculated. In the simple example being described here, calculating this difference results in, approximately, multiplying by $\omega_m$. Accordingly, for the new sample point, the result is, approximately, $I(t)\omega_m\sin(\omega_m t)$.

To compute this difference, the address logic 168 for the delay memory 166 causes the previous phase output for Oscillator 0 to be output, and it passes through the shifter 174, multiplexer 146 and adder/subtractor 150, none of which modify it, to the phase accumulator 152, in which it is stored. Once this is completed, the control logic 148 causes the multiplexer 146 to access the output of Oscillator 0 for the new sample point, which is $I(t)\sin(\omega_m t)$, from the delay memory 166. The multiplexer 146 passes this next sample output as one input to the adder/subtractor 150, while at the same time the control logic 148 and a bank of AND gates 144 cause the previous sample output that is now being stored in the phase accumulator 152 to be passed as the other input to the adder/subtractor 150, which subtracts Oscillator 0's previous sample output from Oscillator 0's output for the new sample point. In the simple example being described here, the result is, approximately, $I(t)\omega_m\sin(\omega_m t)$.

Next, to generate Oscillator 1's phase for the new sample point, the cumulative phase for the previous sample point for Oscillator 1 must be added to the sum of the phase increment for Oscillator 1, which is $\omega_c$, and the output of the highpass filtered output of Oscillator 1's modulation oscillator, Oscillator 0, which output is $I(t)\omega_m\sin(\omega_m t)$. For the new sample point, this sum becomes, approximately, $[\omega_c+I(t)\omega_m\sin(\omega_m t)]t$.

To compute this sum, the address logic 168 for the delay memory 166 causes it to output the previous phase output for Oscillator 1, which then passes through the shifter 174 and multiplexer 146, neither of which modify it, to the adder/subtractor 150, which adds it to the contents of the phase accumulator 152. In the simple example being described here, those contents are the highpass filtered output of Oscillator 0, or $I(t)\omega_m\sin(\omega_m t)$. This is done by having the multiplexer 146 pass the previous sample output for Oscillator 1 as one input to the adder/subtractor 150, while at the same time the control logic 148 and the bank of AND gates 144 cause the previous sum that is stored in the phase accumulator 152 to be passed as the other input to the adder/subtractor 150, which adds the two quantities. As before, this new sum is stored in the phase accumulator 152.

Finally, the multiplexer 146 obtains the phase increment for Oscillator 1, which is $\omega_c$, from the fourth parameter latch 142*d*. The multiplexer 146 passes the phase increment ($\omega_c$) on as one input to the adder/subtractor 150, while at the same time the control logic 148 and the bank of AND gates 144 cause the previous sum that is stored in the phase accumulator 152 to be passed as the other input to the adder/subtractor 150, which adds the two quantities.

Note that any or all of the additions and subtractions discussed above can be performed modulo $2\pi$, which scales the size of the phase accumulator word to $2\pi$. The result of all these additions and subtractions is the new phase for Oscillator 1, or $[\omega_c+I(t)\omega_m t)]t$ for the new sample point, which is then stored back into the phase memory 154.

Next, $\sin([\omega_c+I(t)\omega_m\sin(\omega_m t)]t)$ must be calculated for the new sample point. This is done by the waveshaping circuit 158, which obtains the phase for Oscillator 1 from the phase memory 154 and transforms it into the desired waveform according to the waveshape parameters contained in the third parameter latch 142*c*. In the simple example being described here, the output of the waveshaping circuit 158 is, approximately, $\sin([\omega_c+I(t)\omega_m\sin(\omega_m t)]t)$ for the new sample point. As noted above, although the phase incrementing operation described above and the waveshaping operation are described as occurring in sequence, in a more optimal design the circuit can have the two operations occur simultaneously.

The envelope generator 160 then obtains information about the key state (on or off) and the attack, decay, sustain and release parameters from the first parameter latch 142*a*, and computes the current envelope value for Oscillator 1. The amplitude logic block 162 then takes this current envelope value, obtains amplitude parameters stored in the second parameter latch 142*b*, and computes from these values an amplitude for Oscillator 1 for the new sample point. An amplitude multiplier 164 then multiplies the output of the waveshaping circuit 158 by the amplitude. The output of the amplitude multiplier 164, which is approximately $A(t)\sin([\omega_c+I(t)\omega_m\sin(\omega_m t)]t)$ in the simple example being described here, is then stored in the delay memory 166, replacing the twice previous output sample for Oscillator 1.

As discussed above, the remainder of the circuit enables the summing of the output of an oscillator with that of the previous oscillators for the same sample. In the simple example being described here, these operations are not necessary, and this circuitry is not used.

After both oscillators have been processed, based on the contents of the fifth parameter latch 142*e*, the output control logic 172 causes the contents of the accumulator 180 to be passed to the audio output latch 182, and the accumulator 180 to be cleared using the AND gates 176. Processing then begins for a new sample beginning with Oscillator 0. In this way, a signal representing a synthesized musical sound is generated at the audio output latch 182, where it can be amplified, as appropriate, and used to power a speaker where it can be heard. This FM synthesis process occurs in real time.

As noted above, according to the teachings of this specification, the circuit of FIG. 10 can be used to support a variety of FM topologies, such as self-modulation, cascading and simultaneous generation of several musical notes, in ways that are well known to those skilled in the art. As also noted above, tonal qualities, such as tremolo and vibrato, can also be implemented in the present invention by varying $\omega_c$, $\omega_m$ and $A(t)$ by combining techniques well known to those skilled in the art with the teachings of this specification.

Finally, it should be noted that the parameters can be stored in a variety of formats in the parameter memory 138, which allows for compatibility with existing synthesizers. In such cases, additional logic may be needed to interpret the data in the parameter latches 142 into the correct format.

What is claimed is:

1. A circuit to synthesize sounds comprising:

a modulation phase increment oscillator for producing a modulation signal from a modulation phase increment and a modulation index;

a filter for producing a filtered version of the modulation signal;

an adder for producing a sum of the filtered version of the modulation signal and a carrier phase increment; and a carrier phase increment oscillator for producing an audio signal from the sum.

2. The circuit of claim 1 wherein the carrier phase increment oscillator comprises circuitry for producing the audio signal from the sum and an amplitude envelope.

3. The circuit of claim 1 wherein the modulation phase increment and/or the carrier phase increment is time varying.

4. The circuit of claim 2 wherein the modulation index and/or the amplitude envelope is time varying.

5. The circuit of claim 1, wherein said oscillators are audio-rate oscillators.

6. A method of synthesizing sounds comprising the steps of:

producing a modulation signal from a modulation phase increment and a modulation index;

filtering the modulation signal;

adding the filtered modulation signal and a carrier phase increment to obtain a sum; and producing an audio signal from the sum.

7. The method of claim 6 wherein the producing step comprises producing an audio signal from the sum and an amplitude envelope.

8. The method of claim 6 wherein the filtering step comprises using a highpass filter.

9. The method of claim 8 wherein the filtering step comprises using a first order FIR highpass filter.

10. The method of claim 6 wherein the step of producing a modulation signal comprises waveshaping.

11. The method of claim 10 wherein the waveshaping step comprises producing sinusoidal waveforms.

12. The method of claim 10 wherein the waveshaping step comprises producing non-sinusoidal waveforms.

13. The method of claim 6 wherein the step of producing a signal comprises waveshaping.

14. The method of claim 13 wherein the waveshaping step comprises producing sinusoidal waveforms.

15. The method of claim 13 wherein the waveshaping step comprises producing non-sinusoidal waveforms.

16. The method of claim 6 wherein the step of producing a modulation signal comprises multiplying.

17. The method of claim 6 wherein the step of producing a signal comprises multiplying.

18. The method of claim 6 wherein at least one of the steps is time division multiplexed.

19. The method of claim 6 wherein at least two of the steps utilize the same adder circuitry.

20. The method of claim 6 wherein the modulation phase increment and/or the carrier phase increment is time varying.

21. The method of claim 7 wherein the modulation index and/or the amplitude envelope is time varying.

22. A circuit to synthesize sounds by self-modulation comprising:

a phase increment oscillator for producing a self-modulation signal from a first phase increment, where the self-modulation signal is also used as a signal representing a sound;

a delay operator which delays the self-modulation signal;

a filter for producing a filtered version of the self-modulation signal; and an adder for producing a sum of the filtered version of the self-modulation signal and a second phase increment, where the sum is the first phase increment.

23. The circuit of claim 22 further comprising a shifter, disposed between the delay operator and the filter, which multiplies the delayed self-modulation signal by a fixed amount.

24. The circuit of claim 23 wherein the modulation phase increment oscillator comprises circuitry for producing the self-modulation signal from the first phase increment and an amplitude envelope.

25. The circuit of claim 24 wherein the amplitude envelope is time varying.

26. The circuit of claim 22, wherein said oscillators are audio-rate oscillators.

27. A circuit to synthesize sounds by cascading comprising:

at least two modulation phase increment oscillators comprising circuitry for producing a modulation signal from a modulation phase increment and a modulation index, wherein at least one of the at least two oscillators receives the filtered output of a previous of the at least two oscillators;

at least one filter comprising circuitry for producing a filtered version of at least one of the modulation signals produced by at least one of the modulation phase increment oscillators;

at least one adder comprising circuitry for producing a sum of the filtered version of at least one of the modulation signals and a second modulation phase increment; and a carrier phase increment oscillator for producing a signal representing a sound from the sum of the filtered and added outputs of the at least two modulation phase increment oscillators.

28. The circuit of claim 27 wherein the carrier phase increment oscillator comprises circuitry for producing the signal representing a sound from the final sum produced by the at least one adder and an amplitude envelope.

29. The circuit of claim 28 wherein the modulation index and/or the amplitude envelope is time varying.

30. A circuit to synthesize sounds comprising:

a digital filter having an input connector and an output connector;

a first digital phase increment oscillator having an output electrically connected to said input connector, storing a first phase value, and incrementing said first phase value at each successive sample period by a first input phase increment; and a second digital phase increment oscillator having an input electrically connected to said output connector of said digital filter, storing a second phase value, and incrementing said second phase value at said each successive sample period by a second input phase increment at least partially provided by said output connector of said digital filter.

31. A circuit to synthesize sounds according to claim 30 wherein:

said first digital phase increment oscillator is a digital modulation phase increment oscillator; and said second digital phase increment oscillator is a digital carrier phase increment oscillator.

32. A circuit to synthesize sounds according to claim 31 wherein said digital filter is a highpass filter.

33. A circuit to synthesize sounds according to claim 32 wherein said digital filter is a first order FIR highpass filter.

34. A circuit to synthesize sounds according to claim 31 wherein said first digital phase increment oscillator includes a first waveshaper accepting said first phase value at said each successive sample period as input to produce a first desired waveform.

35. A circuit to synthesize sounds according to claim 34 wherein said desired waveform is a sinusoidal waveform.

36. A circuit to synthesize sounds according to claim 34 wherein said desired waveform is an audio waveform.

37. A circuit to synthesize sounds according to claim 34 wherein said first digital phase increment oscillator includes a first multiplier multiplying said desired waveform by a first amplitude.

38. A circuit to synthesize sounds according to claim 37 wherein said first amplitude is time-varying.

39. A circuit to synthesize sounds according to claim 31 wherein said first phase increment input is time-varying.

40. A circuit to synthesize sounds according to claim 31 wherein said second digital phase increment oscillator includes a second waveshaper accepting said second phase value at said each successive sample period as input to produce a second desired waveform.

41. A circuit to synthesize sounds according to claim 40 wherein said second desired waveform is a sinusoidal waveform.

42. A circuit to synthesize sounds according to claim 40 wherein said second desired waveform is an audio waveform.

43. A circuit to synthesize sounds according to claim 40 wherein said second digital phase increment oscillator includes a second multiplier multiplying said second desired waveform by a second amplitude.

44. A circuit to synthesize sounds according to claim 43 wherein said second amplitude is time-varying.

45. A circuit to synthesize sounds according to claim 31 wherein said second phase increment input is time-varying.

46. A circuit to synthesize sounds according to claim 31 further comprising:

an adder at least partially providing said electrical connection between said output connector of said digital filter and said input of said second digital phase increment oscillator, and adding an output signal from said digital filter to an instantaneous carrier phase increment to produce said second input phase increment.

47. A circuit to synthesize sounds according to claim 46 wherein at least two of said first digital phase increment oscillator, said second digital phase increment oscillator, and said adder share adder circuitry.

* * * * *